US007322465B2

(12) United States Patent
Harper

(10) Patent No.: US 7,322,465 B2
(45) Date of Patent: Jan. 29, 2008

(54) METHODS OF USING LIQUID PACKETS WITH ADVERTISING INSERTS

(76) Inventor: William Anthony Harper, 16541 Redmond Way, pmb 140c, Redmond, WA (US) 98052-4492

( * ) Notice: Subject to any disclaimer, the term of this patent is extended or adjusted under 35 U.S.C. 154(b) by 0 days.

(21) Appl. No.: 11/451,201

(22) Filed: Jun. 12, 2006

(65) Prior Publication Data

US 2007/0045133 A1 Mar. 1, 2007

Related U.S. Application Data

(62) Division of application No. 10/697,067, filed on Oct. 30, 2003, now Pat. No. 7,163,101.

(51) Int. Cl.

| | |
|---|---|
| ***B65D 81/24*** | (2006.01) |
| ***B65D 35/14*** | (2006.01) |
| ***B65D 85/00*** | (2006.01) |
| ***G06K 7/00*** | (2006.01) |
| ***B42D 15/00*** | (2006.01) |

(52) U.S. Cl. ..... 206/210; 40/326; 206/459.5; 222/107; 283/56; 283/67

(58) Field of Classification Search ..... 206/210, 206/459.1, 459.5, 229, 812, 484–484.2; 134/6; 383/106; 426/112–115; 40/310, 326; 222/92, 222/94, 107; 283/56, 67

See application file for complete search history.

(56) References Cited

U.S. PATENT DOCUMENTS

| | | | | |
|---|---|---|---|---|
| 165,628 | A | | 6/1875 | Strunz |
| 713,606 | A | | 11/1902 | Cole |
| 956,937 | A | | 5/1910 | Cadwell |
| 1,827,549 | A | | 10/1931 | Villain |
| 1,983,002 | A | | 12/1934 | Reeves |
| 2,093,976 | A | | 9/1937 | Farmer |
| 2,264,194 | A | * | 11/1941 | Wuestman ..... 40/326 |
| 2,298,421 | A | | 10/1942 | Salfisberg |
| 2,572,056 | A | | 10/1951 | Salfisberg |
| 3,224,640 | A | * | 12/1965 | Schneider et al. ..... 222/107 |
| 3,413,230 | A | | 11/1968 | Dupuis |
| 3,759,379 | A | * | 9/1973 | Wrede ..... 206/484.2 |
| 4,591,328 | A | | 5/1986 | Cheung |
| 4,797,291 | A | | 1/1989 | Pierce |
| 4,837,956 | A | | 6/1989 | Dolence |
| 5,492,644 | A | | 2/1996 | Minkin |
| 5,814,159 | A | | 9/1998 | Paley |
| 5,869,437 | A | | 2/1999 | Wolfersberger |
| 5,871,096 | A | | 2/1999 | Yakich |
| 5,937,554 | A | | 8/1999 | Haugk |
| 6,073,373 | A | | 6/2000 | Haugk |
| 6,184,191 | B1 | | 2/2001 | Wolfersberger |
| 6,451,397 | B1 | * | 9/2002 | Hagen ..... 206/484 |

(Continued)

OTHER PUBLICATIONS

Hooper, Judith (1999) A New Germ Theory; Atlantic Monthly; Feb. 1999; http://www.the atlantic.com/issues/99feb/germs.htm.

(Continued)

*Primary Examiner*—Bryon P Gehman

(57) ABSTRACT

A transparent or partially transparent polymer packet is described containing a hand sanitizing fluid in which floats a printed insert. Inclusion of the message-bearing insert promotes the distribution and use of the hand sanitizing fluid for improving hand hygiene.

16 Claims, 2 Drawing Sheets

U.S. PATENT DOCUMENTS 7,163,101 B2 * 1/2007 Harper ..... 206/210

OTHER PUBLICATIONS

Earl, M. L.; Jackson, M. M. and Richman, L. S. (2001) Improved Rates of Compliance with Antisepsis, Guidelines; American Journal of Nusing; Mar. 2001, 101 (3): 26-33.

Pittet, D. (2002) Promotion of Hand Hygiene: Magic, Hype, or Scientific Challenge?; Infection Control and Hospital Epidemiology; Mar. 2002; 23(3).

Dyer, D. L.; Shinder, A.; Shinder, F.; (2000) Alcohol-free Instant Hand Sanitizer Reduces Elementry School Illness Absenteeism; Family Medicine; Oct. 2000; 32(9); 633-8.

* cited by examiner

METHODS OF USING LIQUID PACKETS WITH ADVERTISING INSERTS

This is a Divisional Application of parent application Ser. No. 10/697,067 filed 30 Oct. 2003 now U.S. Pat. No. 7,163,101.

FIELD OF THE INVENTION

This invention concerns polymer packets containing both liquids and inserts whereby communications carried by the insert encourages packet distribution and subsequent beneficial use of the dispersed fluid.

BACKGROUND OF THE INVENTION

It is well understood that microbiological pathogens on the hands are transferred to other body parts such as the mouth, nose and eyes and this transfer is the primary route for infectious disease in humans. The actual extent of the damage caused by infections resulting from hand-borne pathogens is generally less known. Fully eighty percent of all infections ranging from the usually benign cold, through the more debilitating flu, to the truly horrific Ebola, are transmitted by touch. The average American will contract two to four cold or flu infections in a typical year, and experience four to six significant gastrointestinal disruptions during the same period. Colds alone account for an annual loss in the United States of at least 300 million person days of work and school annually; flus cost Americans $10 billion a year in lost wages and medical expenditures in addition to nearly 50,000 deaths each year from influenza complications. Additionally, over and above the easily recognized onset of miseries characterized by the likes of a Norwalk virus attack, there is a growing body of evidence and in some cases solid proof that many major chronic diseases like gastric ulcers, stomach cancer, heart disease, cervical cancer, ALS (Lou Gehrig's disease), and Alzheimer's, most characterized by a much delayed onset, are infectious germ-based diseases that follow the same hand-based route into the body as the common cold rhinovirus. The scope of this generally unrecognized hidden plague associated with infectious diseases has been discussed for years within the medical community and more recently has found its way into the popular press, *Atlantic Monthly,* February 1999, (*"A New Germ Theory"*). It is sobering to realize the risk of a hand-borne infection is not just the occasional case of the sniffles but possibly the source of a life-long debilitating disease, a crippling condition leading to an early death, or even a tragic living death that strangles all hope and affection. For years the famed Mayo Clinic has offered this blunt slogan in an attempt to drive home the need for effective hand hygiene to combat serious diseases: "The ten worst sources of contagion are our fingers."

Each year more than 2 million hospital acquired (nosocomial) infections occur in the United States, costing some $4.5 billion in additional charges. The Centers for Disease Control estimates more than half of healthcare associated infections can be prevented through better infection control programs of which hand cleaning is the centerpiece for reducing the spread of infection. Hospitals are only one of many organizations burdened with hand-borne disease costs. A recent school study found that classrooms that made hand sanitizing fluid dispensers simply available for use showed a 20% reduction in student absenteeism due to illness as well as a 10% decrease in teacher absenteeism. Several recent articles provide an understanding of the current level of technology available for hand sanitation and further describe the significant problems the art of infection control faces.

In March 2001 an *American Journal of Nursing* article (*"Improved Rates of Compliance with Hand Antisepsis . . . "*) stated that at least 80,000 hospital deathsoccur each year as a result of nosocomial infections contracted during their stays. Further, that "it's common knowledge that the hands of heath care workers can carry disease-causing organisms from one patient to another and that hand antisepsis before and after each patent contact is crucial to the prevention and control of nosocomial infection." The reasons most often cited by hospital staff for failing to clean their hands adequately are inconvenience and no time. Given the hectic and demanding nature of their workload these are not excuses but simply statements of reality. That convenience and time are critical factors in maintaining hand sanitation is underscored by the finding in this study that placing hand sanitizing fluid dispensers "in the hallways outside patient rooms were nearly 30 times more likely to be used than dispensers mounted anywhere inside the rooms." Yet the most disturbing finding of this study was that full compliance with hand antisepsis guidelines was an unrealistic goal. That while hand sanitizing fluids took less time than washing and the placement of numerous dispensers bottles made matters somewhat more convenient, even with the heightened attention impact of the study itself (the Hawthorne effect), compliance did not achieve more than 60% at any time during the study. And it is well understood that over time, after the study is done and gone, a drift back to much lower compliance rates is inevitable; the dispenser bottle becomes just one more thing in the room, like soap at the sink, rarely used and only when time and convenience allowed.

In March 2002 an article in *Infection Control and Hospital Epidemiology* (*"Promotion of Hand Hygiene: Magic, Hype, or Scientific Challenge?"*) restates the conditions for promoting adequate hand hygiene. "Among enabling factors, engineering control must be considered for the successful promotion of hand hygiene. In particular, it involves making hand hygiene easy, convenient, and possible in a timely fashion." Another observation made is that the higher rates of compliance seen in studies can only be sustained when some form of cost-effective, non-intrusive monitoring is invented. "My personal opinion is that obtaining a sustained and never-ending Hawthorne effect associated with improved compliance with hand hygiene and decreased infection and cross-transmission rates should be the dream of every hospital epidemiologist. Let's find a cost-effective way to induce it." To date this need and its underlying causes remain unmet both in the marketplace and the published art.

A final article in the October 2000 issue of *Family Medicine* (*"Alcohol-free Instant Hand Sanitizer Reduces Elementary School Illness Absenteeism"*) reports a remarkable reduction in absenteeism when hand sanitizers were introduced in public school classrooms. Results showed students using hand sanitizing fluids "were found to have 41.9% fewer illness-related absence days, representing a 28.9% and a 49.7% drop in gastrointestinal- and respiratory-related illness, respectively . . . Conclusion: Daily use of the instant hand sanitizer was associated with significantly lower rates of illness-related absenteeism." In this study the close monitoring and continual instruction of the test group by teachers largely abrogated the issues of time and convenience. Nevertheless, it clearly indicates the significant impact consistent and rigorous hand sanitation can have in schools and the implications for parallel benefits at all levels of society are obvious. As the reports point out in describing the interlinking cost of disease "Even if one doesn't have school-age children, it is necessary to understand the importance and benefits of good hand hygiene, not only in clinical practice but also in the greater community. Vital tax dollars will be saved on expenses for remedial student services and employee work time by this simple and effective way to decrease illness-related absenteeism."

That the use of hand sanitizing fluids can significantly reduce infections and disease is beyond question, but the problem remains of how to establish widespread use. Despite their presents in hospitals and the marketplace for years the evidence shows a lack of effective impact. Part of the problem lies in development of a useful, convenient and affordable apparatus, a devices that flows naturally with the rhythms of the workplace or daily life. In hospitals and schools placing dispensers at doors produced statistically significant improvements in hand hygiene; it has also been shown that recidivism is immediate when compliance monitoring stops. Dispensers hung on walls or set on counters have proven only marginally effective in the controlled environment of hospitals and schools; in public areas their effectiveness drops to near zero. The state of the art as defined by the marketplace and patent literature provides neither devices nor methods that adequately address this problem.

To improve hand hygiene in the general population two basic and novel developments need to take place. The first is development of an apparatus, a device that is inexpensive, disposable, multi-dose, small, convenient, self-sealing, ubiquitous, inconspicuous, a pocket carried packet dispenser of hand sanitizing fluid that is accessible in a timely manner in the course of a day's normal activities. An apparatus with these specifications is described in U.S. Pat. No. 7,004,354 to Harper wherein an Athand™ packet is disclosed. The second development necessary for improved hand hygiene is creation of a robust and effective means to promote the distribution and retention of the Athand packet so it is available at a time and place of appropriate need.

The Harper application describes the use of various forms of advertising and gaming in an attempt to achieve widespread distribution and retention of the packets. Harper explicitly describes the printing of various forms of promotional data including advertising messages, internet addresses, company names and the like on the exterior surface of the packets. Using this marketing format the hand sanitizing fluid packet comes close to becoming the twenty-first century equivalent of the last century's ubiquitous matchbook. But there are problems with the conventional exterior printing of packets as described by Harper. First, the packet space available is very small and must compete with necessary regulatory information. Second, the nature of the reproducible art possible to practice on the packet is very constrained in terms of design, complexity and even content because the substrate is functionally designed for its primary purpose of containing, preserving and dispersing the hand sanitizing fluid. Third, package printing is necessarily a high volume, mass production process where sameness is the rule both economically and operationally, this precludes any variation for essential custom marketing at a reasonable cost. Fourth, there is no overwrapping of the small flexible packet with packaging or even sufficient structure for attaching any form of promotion. Finally, packet printing is highly restrictive to the type of value adding promotions possible, it virtually precludes and question/answer format and curtails any following use because of the nature of being a disposable packet. Printing the packaging in the conventional manner of Harper is a useful step in achieving hand sanitizing fluid packet distribution but it is likely insufficient given the denoted limitations of the technique to achieve the deep and wide market penetration. Simply put, a new, novel and effective means of hand sanitizing fluid promotion needs to be created that can surmount the limitations imposed by small, disposable packets of liquid.

In the published literature and patent databases no solutions and minimal prior art could be found that gave guidance for overcoming the limiting design factors imposed by the Athand packet. Patents concerning fortune cookies disclosed techniques for embedding highly customized strips of paper bearing messages in various baked goods which do not lend themselves to packaging or surface printing (see U.S. Pat. No. 4,591,328 to Cheung and U.S. Pat. No. 4,797,291 to Pierce). Numerous patents disclosed variations on the surprisingly long-life technique of embedding promotions in the center of soap bars where the message stays viable even as the bar is consumed (see U.S. Pat. No. 165,628 to Strunz; U.S. Pat. No. 1,827,549 to Villain; U.S. Pat. No. 1,983,002 to Reeves; U.S. Pat. No. 3,413,230 to Dupis; U.S. Pat. No. 5,492,644 to Minkin; U.S. Pat. No. 5,869,437 to Wolfersberger; and U.S. Pat. No. 6,184,191 to Wolfersberger). Coupons inserted in various packaging formats to promote the associated products are described in many patents (see U.S. Pat. No. 4,837,956 to Dolence; U.S. Pat. No. 5,871,069 to Yakich; and U.S. Pat. No. 6,421,986 to Dharssi for examples). But none addressed the issues raised by the Athand packet concerning size, surface, uniqueness, structure, and format. Indeed, the problems broadened, every patent that discussed the issue of insert such as coupons warned of the soiling, spoilage and general contamination problems associated with placing any value adding component in direct contact with the packaged product (ibid. Dolence, Yakich, and Dharssi). This is especially true for liquid products in that nothing in the literature or patents was found describing a floating insert in a polymeric packet containing a liquid. The prior art teaches away from any value adding insert being in direct contact with any product, and given the small size and nature of the packet, compounded by the aggressive qualities of hand sanitizing fluids such as the caustic effect of alcohol, the guidance offered by prior art was simply misleading.

Research offered little, all references were found deficient in one or more respects. Significantly, none of the above references taken in part or as a whole presented an effective way to fabricate highly varied, small batches of promotional messages in a very small format, with high quality reproductive art, at the minimal expense imposed by the necessarily low product cost and disposable nature of the product. None overcame these and other problems, none suggested any advancement to current art in the manner of the present invention.

SUMMARY OF THE INVENTION

The present invention recognizes and addresses the foregoing disadvantages and shortcomings of the prior art. Accordingly, it is a primary intent of the present invention to provide a distinctly novel concept (the insert in liquid packet) and equally important innovative method where the desirability of the message content overcomes the problems of availability and timely employment which have previously curtailed the effective use of hand sanitizing fluids by the general population.

By experimentation surprising results were eventually achieved with certain forms of inserts placed in direct contact with hand sanitizing fluids. First tests confirmed that insert substrates either disintegrated or were otherwise damaged by liquids as cautioned by the prior art. Inks, specifically FDA approved inks for direct product contact, ran and leached on contact with even the least aggressive hand sanitizing fluids. Continued testing lead to use of chemically resistant polymers like polypropylene that did not deteriorate in the presence of a wide variety of fluids, but printing inks on polymer substrates still encountered problems when exposed to various product solvents. What finally proved adequately resistant were printing system using heat fusible toners like those associated with laser printing systems. This use of inserts constructed of polymer substrates bearing fused toner communications resolved all five of the issues that had made the earlier prospects of hand sanitizing fluid packet promotion seem very doubtful. First, the space allowed for communication had been at least doubled by use of the insert. Second, given that the insert was a separate piece of material it could have any number of surfaces and other characteristic neither practical nor desirable for packet construction. Third, the separate nature of the insert allowed for a unique communication on each without interfering with the necessary high-speed packaging requirements where the packet forming film unrolls by the mile. Fourth, given the pack's small size, flexibility and disposable construction and where there is no foundation for attachment without functional interference, the insert provided useful rigidity to the packet. And finally, fifth, the insert opened the opportunity to include not only the question and answer format but a great variety of other value adding forms of communication all of which contribute novel techniques that promote hand sanitizing fluid packet distribution and retention.

Consequently, a primary object of the present invention is to provide a novel and significant advancement in the art of hand sanitizing fluid promotion by disclosing an arrangement of parts wherein an insert is placed inside a flexible polymeric packet with the fluid, and the insert bears a meaningful communication designed to enhance distribution, retention and use of the hand sanitizing fluid product for improved hand hygiene by means of the inherent desirability of the communication.

Another object of the present invention is to provide a novel and significant advancement in the art of liquid packaging in the form of small packets containing a wetted insert wherein the packaged useful liquid and value adding insert are viewable.

Another object of the present invention is disclosure of a method where the communication borne on the insert is the purpose of the distribution and the value adding quality of the packet and its contents are a useful conveyor of the message.

Yet another object of the present invention is a method to bias liquid packet selection based on requiring the user to acquire the entire packet, with product, to obtain the insert bearing a communication.

A final object of the present invention is the use of the apparatus and methods outlined in the proceeding in generalized packets using other fluids Other objects and advantages of the present invention will become apparent from the following description taken in conjunction where appropriate with the accompanying drawings wherein are set forth, by way of illustration and example, certain embodiments of this invention. The drawings constitute a part of this specification and include exemplary embodiments of the present invention illustrating various objects and features thereof.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
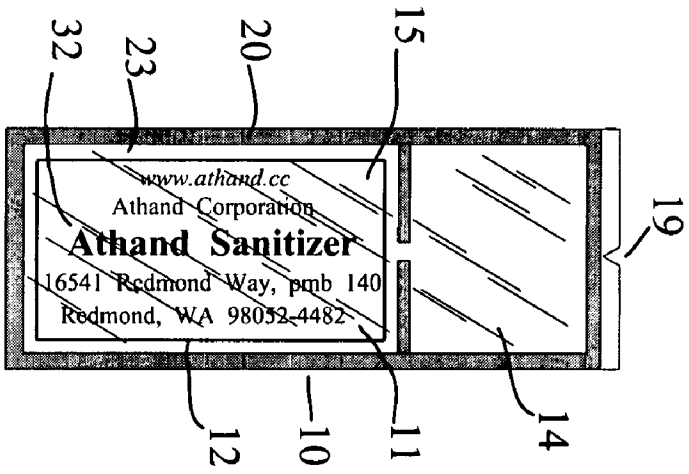
FIG. 1 is a frontal view of the preferred embodiment of the dual chambered hand sanitizing fluid dispensing packet (10), with the insert (15) enclosed. Message (32) is of a business card format.

While the invention will be described in connection with illustrations, descriptions, and examples of preferred embodiments, it will be understood these are not intended to limit the present invention only to these embodiments. On the contrary, the present invention is to cover all structural and/or functional alternatives as defined by the appended claims. The following terms are defined to provide clarity to subsequent discussions and claims The term "hand sanitizing fluid" as used herein refers to any non-irritating, antimicrobial-containing composition in the form of a fluid, gel, spray, foam, cream, lotion, or tincture preparation designed for frequent use that can reduce the number of transient microorganisms, specifically pathogens, when applied to and dispersed over the hands and other skin areas. Such preparations have a broad antimicrobial spectrum, are fast-acting, and often persistent. Representative of such agents are alcohols (e.g. ethyl and isopropyl), iodines (e.g. hexachlorophene), bisbiquanides (e.g. Chlorhexidine digluconate), and quaternary ammonium salts (e.g. Benzalkonium chloride) which are formulated singularly or in combination. This term is specifically intended to include all such preparations, known and unknown, that are capable of achieving a substantial reduction of skin resident pathogens when applied to the hands or other areas of human skin where such pathogens are found.

The term "polymeric packet" as used herein refers to a packet constructed with any polymer film capable of being constructed into a packet packaging form of two principle sidewalls joined at the edges for containment and preservation of a useful liquid. Such polymer films as may prove useful for this purpose have sufficient flexibility to yield to finger pressure, are sufficiently durable to withstand reasonable hydraulic pressure created by fingers, have good crack and puncture resistance, have very good chemical resistance and low gas permeability, and are capable of being sealed to self or other materials. Representatives of single formulation films are polypropylene and polyethylene. Numerous grades, gauges, clarities, colors, textures, manifold laminations of diverse films and foils, formed by many techniques, with numerous properties and qualities, resulting from an even greater numbers of formulations, provide a wide array of polymeric materials to select from, singularly or in combination, to satisfy the specific chemical, physical, and aesthetic attributes required for a specific packet's construction, its content's formulation, and the precise function for which it is intended. In any circumstance where food or drug contact with a polymer material occurs, U.S. FDA approved food grade polymeric material are recommended. All known and yet unknown polymer materials functionally suited for use in constructing polymeric packets containing useful liquids are envisioned by use of this term.

The term "meaningful communications" as used herein refers to any informational, educational, entertainment, and similar content exchange techniques expressed in any visible or tactile format. Specifically, any and all forms of the graphic arts including the printed word, pictorial representations, photography, illustrations, art and similar sight or tactile based forms of communication. Included are recent advancements in reprographic technologies such as embossed and printed holograms, laser printing, inkjet printing, rainbow printing and the older dimensional forms such as intaglio printing are specifically included. The content of the communication can takes many forms, including anagrams, addresses, advertising messages, call numbers, campaign points, catechisms, codes, company names, copyright materials, dates, event commemorations, decorative arts, facility names, formulas, fortune predictions, examinations, gaming symbols, illustrations, information, instructions, internetaddresses, jokes, logos, lottery numbers, lottery symbols, lyrics, logogriphs, maxims, meaningful symbols, meaningful images, notations, questions, quips, photos, poetry, prayers, promotions, promotional slogans, proverbs, puzzles, quizzes, quotations, raffle numbers, redemption values, religious references, riddles, sayings, schedules, study aids, telephone numbers, tests, trademarks, voting messages, web addresses, witticisms, word definitions, word games and similar subject material.

The term "Tagins" as used herein is a proprietary descriptive term used to define all forms of inserts placed in contact with dispensable useful liquids. The term Tagins™ is specifically intended to apply to inserts bearing meaningful communications that are placed with hand sanitizing fluids for the purpose of promoting the distribution and use of the product. Most specifically, the term applies to message bearing insert found in Athand packets dispensing hand sanitizing fluids.

The term "useful liquid" as used herein refers to any substance with the capacity to demonstrate fluidity. Specifically, liquids are described by many forms that include but are not limited to mixtures of homogeneous and non-homogeneous substances, solutions, suspensions, colloids, sols, and similar terms. "Useful" connotes a utility aspect for employing the dispensed liquids characterized by common products, forms, and categories such as additives, adhesives, aftershaves, alcohol solutions, antibiotic ointments, antifungal cream, anti-itch creams, antimicrobial fluids, antiseptic creams, baby formulas, bandages, bath oils, beverages, bleaches, body oils, body washes, breath fresheners, butters, candies, cleaner oils, cleaners, coffee extracts, colognes, colorants, condiments, conditioners, creamers, creams, dairy products, decongestants, deodorants, disinfectants, drinks, edible oils, emulsions, essential oils, eye drops, eye lubricants, fabric conditioners, fabric softeners, fertilizers, flavorings, foods, fragrances, fruit jellies, fruit spreads, fuel treatments, gels, glass cleaners, gravies, greases, hair treatments, hairdressings, hand sanitizers, hand soaps, herbal extracts, honeys, insect repellants, jams, liniments, lip balms, lotions, makeup fluids, margarines, marmalades, medications, mineral solutions, moisturizers, mouthwashes, nectars, oils, ointments, paints, pastes, perfumes, petroleum jellies, polishes, preserves, salad dressings, salsas, sauces, seasonings, shampoos, skin cremes, skin lotions, skin moisturizers, skin toners, soaps, soups, spices, spreads, stain removers, styling creams, styling gels, sugar solutions, sun screens, sweeteners, syrups, tea extracts, toothpaste, vegetable milks, vegetable oils, vinegars, vitamin solutions, waxes, and similar items, descriptions, and functions. This utility quality of the liquid distinguishes "useful liquids" as defined herein from liquids that are never intended for disbursement from their containers such as those found in gel filled mouse pads and like novelties.

The physical expression of the present invention is best understood within a narrative constructed around examples that illustrate and describe how the packet and the insert function, subsequent examples delineate distribution methods derived from the added value of the inserts. Example 1 describes the polymeric packet containing a hand sanitizing fluid in which floats an insert with communication content printed upon it. FIGS. 1-7 are used to illustrate various functions, relationships and alternative expressions of inserted Tagins. Example 2 describes a method wherein Tagins are used to promote hand sanitizing fluid induced hand hygiene by encouraging packet distribution as a means to access Tagins. Further, a method is described wherein the sponsors of the communication content borne on the Tagins employ the packet to spread the message. A final method is described wherein the selection of packets is biased by a desire to obtain the Tagins contained within.

EXAMPLE 1

Packets with Inserts

Figure 2:
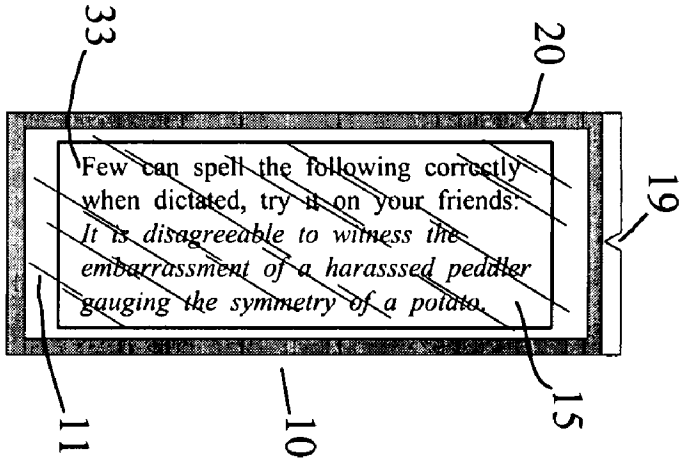
FIG. 2 is a frontal view of a generalized packet (10) structure with insert (15) bearing a spelling quiz (33).

The preferred embodiments of the of the polymeric packet generally designated by the reference number 10 of FIGS. 1 through 7 has a peripheral seal 20 joining front and back sidewalls 23 which have predetermined areas of transparency. These sidewalls 23 may be constructed of flexible polymeric material (e.g., 2-mil polypropylene) to enclose and contain a hand sanitizing fluid 11 (e.g., Purell™ Hand Sanitizer, 62% alcohol) with a floating insert 15 bearing a meaningful communication on at least one surface. In FIG. 1 a dual chamber packet is illustrated, it has a first chamber 12 and a second chamber 14 in fluidic communication whereby a portion of the fluid 11 typically stored in the first chamber 12 is pushed by finger pressure on the flexible sidewalls 23 into the second chamber 14 for dispersal through a tear created at the notch 19 location. In FIG. 2 a more generalized packet form is shown which has only a single cavity for containing a useful liquid 11 for dispensing through a dispersal means as illustrated by the notch 19 in which a tear opening the packet can be made. In the embodiment in which a hand sanitizing fluid is the useful liquid the quality of hand sanitizing fluid dispensed is sufficient for at least one act of hand rubbing with the intent of improving hand hygiene. Overall dimensions for both packet illustrated are 9.0×3.0×0.5 centimeters; the insert 15 thickness ranges from 0.1 to 15.0 mil. In both FIGS. 1 and 2 the inserts 15 are in contact with the surrounding fluids 11 and liquids 11 and are wholly or partially viewable through transparent sidewall 23 areas. Both inserts 15 bear meaningful communications 32, 33 which are shown as viewed through the transparent sidewalls 23. Communication 32 shows data elements arranged in the announcement format of a business card which could be distributed at restaurants, fast food outlets, hospitals, health clinics, dental offices, airlines, hotels, cruise ships, bars, sporting events, conventions and innumerable like venues, facilities and services. Communication 33 shows a classic spelling quiz and memorization aid for eight commonly misspelled words.

Figure 3:
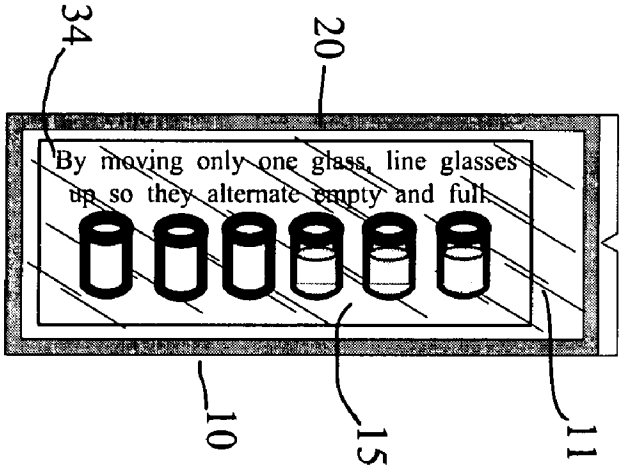
FIG. 3 is a frontal view of a generalized packet (10) structure with an insert (15) bearing a reasoning test communication (34).

FIG. 3 shows a communication 34 where a reasoning test shows six glasses on the front of the insert and the answer is provided on the reverse side of the insert, hidden from immediate view. While the insert substrate may be made of transparent, translucent or opaque polymer film, in this case to make the test useful the insert is opaque. Given that both the front and back sidewalls 23 of the packet 10 are transparent areas simply turning the packet 10 over will reveal the answer. If the back sidewall 23 is not transparent but a designated translucent or opaque area of sidewall 23 the answer of the back of the insert 15 would not be readable and only by fully opening the packet 10 to extract the insert 15 could it be read. Translucent and opaque areas of sidewalls 23 can be formed in at least two ways, by inherent characteristics of the polymeric material constructing the packet 10, or by a surface treatment such as printing or metalizing. If the insert 10 in FIG. 2 with communication 33 were on a transparent substrate it would be useful to provide a designated translucent or opaque area on the back sidewall 23 to enhance viewing of the communication when viewed from the front sidewall 23. This use of predetermined transparent sidewall 23 areas also permits viewing of the hand sanitizing fluid or other useful liquids by the viewer.

Figure 4:
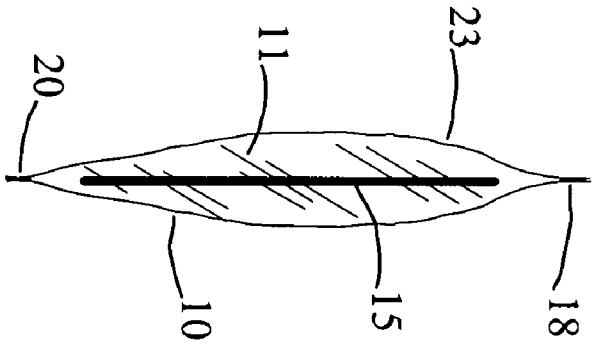
FIG. 4 is a cross-sectional view of a generalized packet (10) with an insert (15) suspended in a liquid (11).

FIG. 4 shows a cross sectional view of a single cavity packet 10 with a single insert 15 floating in a useful liquid 11 environment. The optical quality of the liquid 11 may range from high transparent through translucent, to a quite opaque, and given that the insert 15 is mobile it can be brought through the liquid 11 to a transparent sidewall 23 for viewing. This liquid masking technique can be used and manipulated in a number of intriguing ways to excite viewing interest. Transparent sidewall 23 areas also provide the user with an opportunity to judge the quality, quantity and location of the liquid 11 within the packet 10. An unexpected benefit of fluid 11 or liquid 11 contact with the insert 15 is that wetting of the communication heightens the aesthetic quality of the art form used in creating the communication, far above that experienced when dry. This is particularly true of illustrations, photographs, holographs and similar materials that seem to come alive in a wetted environment. The insert 15 also provides another unexpected benefit by stiffening the entire packet 10 structure, particularly in a partially empty situations, and prevents wadding of the packet 10. Restraint of wadding lessens the choking hazard for small children, makes location access easier, and keeps the communication more easily viewable. The meaningful communications 32, 33, 34 borne by the insert 15 can be created by a number of means, of which one embodiment is printing by laser and toner technology. This specific technology provides numerous advantages that include high resistance to degrading liquids, it permits short runs and even demand insert production, and uses non-toxic toner ingredients. Most toners use in laser and other heat-fixing printing share the same ingredients found in many popular cosmetics and more importantly are often approved by the FDA for food card drug contact. Common toner components are styrene acrylic copolymer, styrene acrylate copolymer, iron oxides, carbon black, polypropylene wax, silica and combinations thereof. A number of reproducing techniques are possible, those using heat fixing methods appear very useful for creating meaningful communications 32, 33, 34 on inserts 15 wetted by liquids 11 within packets 10.

Figure 5:
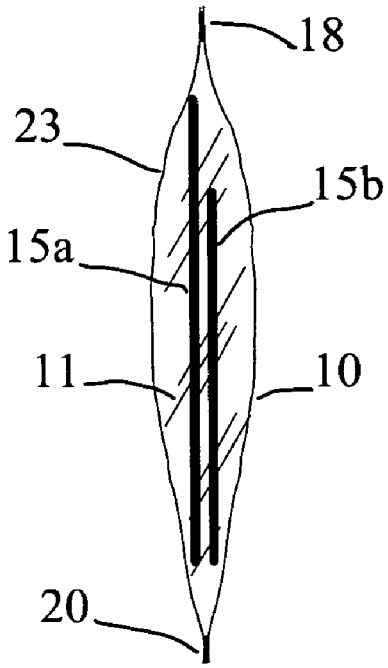
FIG. 5 is a cross-sectional view of a generalized packet (10) with two independent inserts (15*a* and 15*b*) suspended in a liquid (11).
Figure 6:
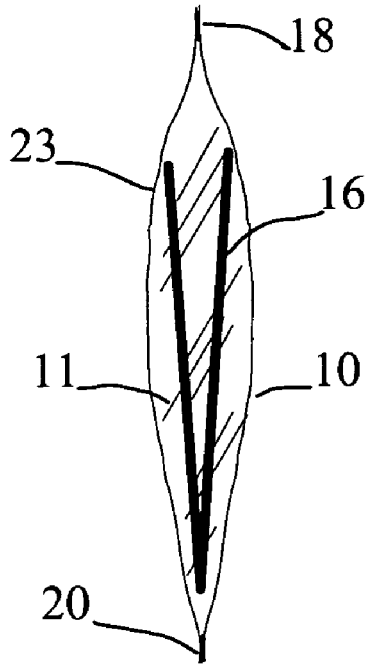
FIG. 6 is a cross-sectional view of a generalized packet (10) with a folded insert (16) in liquid (11).

FIG. 5 shows a packet 10 that contains two inserts 15*a*, 15*b* capable of moving independently of each other. Two or more transparent insert 15*a*, 15*b* can be moved about within the sealed confines of the packet 10 until they align in such a manner as to fully display a communication somewhat divided between the two inserts 15*a*, 15*b*. It is also contemplated that two or more insert 15*a*, 15*b* could bear independent communications on transparent or opaque substrate so each communication is unique to itself and independent of the other. The interplay, gaming, and other features that exist with two or more pieces and their communications are manifold and fully envisioned. FIG. 6 shows a folded insert 16 within a sealed packet 10. Inserts can be folded once, twice or even several times to accommodate rather long or complex communications. The use of durable polymer films can provide a surprisingly large surface area for this type of folding. Also possible with folded inserts is use of material of translucent or opaque inserts 16 to obscure portions of the communication necessitating insert 16 be removed from packet 10 for full viewing.

Figure 7:
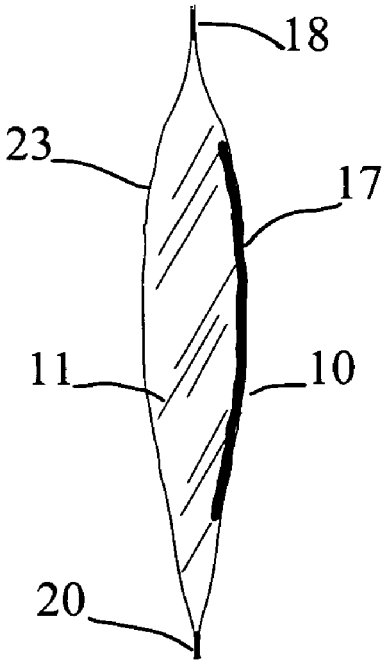
FIG. 7 is a cross-sectional view of a generalized packet (10) with an insert (17) fixed to the sidewall (23).

FIG. 7 shows the insert 17 permanently or detachably sealed on the interior surface of a sidewall 23. This technique is useful for conditions where the opaqueness of the fluid 11 or liquid 11 is used to mask an answer on the inside surface of the insert 17 to a question viewed on the exterior facing surface of the insert 17 that is viewed through a transparent sidewall 23 from the outside. This arrangement somewhat requires the dispensing of the fluid 11 in order to view the answer. There are many other advantages to this arrangement of parts. Single pieces, multiple pieces, folded, rolled, attached, detached or in combinations, the inserts 15, 15*a*, 15*b*, 16, 17 illustrate just some of the considerable range of possible physical formats that can be developed by various arrangements of the parts.

EXAMPLE 2

Methods of Insert Uses

The meaningful communications content and its range of interest is a key component for fostering the use of hand sanitizing fluid packets for improved hand hygiene within the general population. It is the content that will typically first draw the user to the Athand packet and keep them sufficiently intrigued to continue. The act of hand rubbing may well be first experienced as simply a means to disperse an unfamiliar feature of a packet that contains a good joke or engaging puzzle. But in time, with sufficient interest in the insert's communication, the hand rubbing may well become a good habit benefiting one and all. Consider the following scenario where the insert would be offered as a package of 25 packets forming a vocabulary building set. Each packet's insert bears a unique communication offering such as a word definition, synonymic distinctions, capitalization customs, etc. For example, inserts may have the words WRAITH, SPATE, GABIONS and LUGUBRIOUS together with their meanings; another insert my have the words CONFOUND, DUMBFOUND, PUZZLE and NONPLUS and how each has a distinct meaning apart from the others. A full set of 12 packages, 300 insert, encountered on a daily basis would likely have a positive impact on the user's future SAT score, particularly if the inserts were saved and reviewed from time to time. For the grandparent looking for a Christmas gift for a favored grandchild the choice is an easy one. The subject matter for educational inserts is as diverse as any curriculum. Endless scenarios can be constructed where the hand sanitizing fluid packet distribution is encouraged by those users seeking the value adding benefit of the insert's meaningful communication which results in using the now readily available packet for improving hand hygiene through an act of hand rubbing.

A corollary method to the inserts encouraging hand sanitizing fluid usage is where the communication is the message and simply using the packet and its contents as a means to distribute and retain the message. An example of this method would be for a church organization to distribute small sample packets with a useful liquid like honey that includes an invitation to join as declared by the insert's message. The value of the honey is small, the purpose of the distribution resides in the message borne by the wetted insert. Again, a multitude of scenarios can be constructed around this method of advertising.

A final corollary method is where the distribution of the packet is done with the intent that the value adding insert with its meaningful communication will bias its selection over other items, Simply stated, that the useful liquid product packet will be chosen over other offerings in part based on the user's desire to secure the insert sealed within. For example, a small sample packet of high quality liquid hair dressing is selected because the folded insert promises to reveal one thing you can do to attract your mate tonight. Such massaging can bias product selection and lay a foundation for future sales.

It is to be understood that even though numerous characteristics and advantages of the present invention have been set forth in the foregoing description, together with details of the structure, function, and employment of the invention, the disclosures are illustrative only, and changes may be made in details, especially in matters of shape, size, and arrangement of the parts together with content and materials utilized, within the principles of the invention to the full extent indicated by the broad general meaning of the terms in which the appended claims are expressed.

Further, throughout this specification various publications, patents and applications are referenced. The disclosures of these references in their entireties are hereby incorporated by reference in order to more filly describe the state of the art to which the invention pertains. What has been illustrated and described herein is an improvement in certain types of squeezable articles of manufacture representative of fluid containers such as packets made of flexible polymeric material, specifically for dispensing hand sanitizing fluid for hand hygiene, and incorporate value adding inserts bearing meaningful communications which promote distribution of such packets. Additionally, novel methods for employment and distribution of such article types have been described and illustrated by way of functional examples. While these improvements have been illustrated and described with reference to certain preferred embodiments, the present invention is not limited thereto. In particular, the foregoing specification and embodiments are intended to be illustrative and are not to be taken as limiting. Thus, alternatives, such as structural or mechanical or functional equivalents, and other modifications will become apparent to those skilled in the art upon reading the foregoing description. Accordingly, such alternatives, changes, and modifications are to be considered as forming a part of the present invention insofar as they fall within the spirit and scope of the appended claims.

What is claimed is:

1. A method of advertising, comprising the steps of:

providing a user with a polymeric packet with predetermined transparent sidewall areas and containing a quantity of useful liquid product sealed within said packet and a packet-stiffening insert in contact with said liquid product bearing a meaningful communication that is wholly or partially viewable through said transparent sidewall areas of said packet; and at least one of possessing said packet and using said liquid product results in exposure of said user to said meaningful communication on said insert that conveys an advertising message.

2. The method of claim 1 wherein said meaningful communication is selected from a group consisting of anagrams, addresses, advertising messages, call numbers, campaign points, catechisms, chemical notations, codes, company names, copyright materials, dates, event commemorations, decorative arts, facility names, formulas, fortune predictions, examinations, gaming symbols, illustrations, information, instructions, internet addresses, jokes, logos, lottery numbers, lottery symbols, lyrics, logogriphs, mathematical equations, maxims, meaningful symbols, meaningful images, musical notations, notations, questions, quips, photos, poetry, physics notations, prayers, promotions, promotional slogans, proverbs, puzzles, quizzes, quotations, raffle numbers, redemption values, religious references, riddles, sayings, schedules, scientific expressions, study aids, telephone numbers, tests, trademarks, voting messages, web addresses, witticisms, word definitions, word games, and combinations thereof.

3. The method of claim 1 wherein said useful liquid product is selected from a group consisting of additives, adhesives, aftershaves, alcohol solutions, antibiotic ointments, antifungal cream, anti-itch creams, antimicrobial fluids, antiseptic creams, baby formulas, bandages, bath oils, beverages, bleaches, body oils, body washes, breath fresheners, butters, candies, cleaner oils, cleaners, coffee extracts, colognes, colorants, condiments, conditioners, creamers, creams, dairy products, decongestants, deodorants, disinfectants, drinks, edible oils, emulsions, essential oils, eye drops, eye lubricants, fabric conditioners, fabric softeners, fertilizers, flavorings, foods, fragrances, fruit jellies, fruit spreads, fuel treatments, gels, glass cleaners, gravies, greases, hair treatments, hairdressings, hand sanitizing fluids, hand soaps, herbal extracts, honeys, insect repellants, jams, liniments, lip balms, lotions, makeup fluids, margarines, marmalades, medications, mineral solutions, moisturizers, mouthwashes, nectars, oils, ointments, paints, pastes, perfumes, petroleum jellies, polishes, preserves, salad dressings, salsas, sauces, seasonings, shampoos, skin cremes, skin lotions, skin moisturizers, skin toners, soaps, soups, spices, spreads, stain removers, styling creams, styling gels, sugar solutions, sun screens, sweeteners, syrups, tea extracts, toothpaste, vegetable milks, vegetable oils, vinegars, vitamin solutions, waxes and combinations thereof.

4. The method of claim 1 further comprising the step of favorably biasing the selection of said packet by said user by means of said user desiring to obtain the said meaningful communication borne by said insert within said packet.

5. The method of claim 1 wherein said insert carries a redemption value redeemable by a designated advertising source.

6. The method of claim 1 further comprising the step of saving said insert for future use of said meaningful communication whereby said advertising message continues to be conveyed with each future usage.

7. The method of claim 6 wherein said insert bears the data elements of a business card.

8. A method of advertising, comprising the steps of:

providing a user with a polymeric packet with predetermined transparent sidewall areas and containing a quantity of useful liquid product sealed within said packet and a packet-stiffening insert in contact with said liquid product bearing a meaningful communication that is wholly or partially viewable through said transparent sidewall areas of said packet; and removing said insert from said packet by said user to ascertain information thereon whereby said user is exposed to said meaningful communication on said insert that conveys an advertising message.

9. The method of claim 8 wherein said insert is folded at least once and whereby some of said meaningful communication is obscured and requires removal from said packet so the entire said message can be viewed by said user.

10. The method of claim 8 wherein said packet sidewall areas of said insert are sufficiently translucent or opaque to obscure a portion of said meaningful communication located on said insert and requires said insert be removed from said packet to permit said user to view the entire said message.

11. The method of claim 8 wherein said insert is comprised of at least two separate pieces with each bearing a portion of said meaningful communication and where all said pieces must be removed from said packet for manipulation to ascertain the entire said meaningful communication carried on said separate pieces.

12. The method of claim 8 wherein said insert bearing said meaningful communication is a study aid.

13. The method of claim 12 wherein said insert is in the form of a memorization aid.

14. The method of claim 8 wherein said meaningful communication is selected from a group consisting of anagrams, addresses, advertising messages, call numbers, campaign points, catechisms, chemical notations, codes, company names, copyright materials, dates, event commemorations, decorative arts, facility names, formulas, fortune predictions, examinations, gaming symbols, illustrations, information, instructions, internet addresses, jokes, logos, lottery numbers, lottery symbols, lyrics, logogriphs, mathematical equations, maxims, meaningful symbols, meaningful images, musical notations, notations, questions, quips, photos, poetry, physics notations, prayers, promotions, promotional slogans, proverbs, puzzles, quizzes, quotations, raffle numbers, redemption values, religious references, riddles, sayings, schedules, scientific expressions, study aids, telephone numbers, tests, trademarks, voting messages, web addresses, witticisms, word definitions, word games, and combinations thereof.

15. The method of claim 8 wherein said useful liquid product is selected from a group consisting of additives, adhesives, aftershaves, alcohol solutions, antibiotic ointments, antifungal cream, anti-itch creams, antimicrobial fluids, antiseptic creams, baby formulas, bandages, bath oils, beverages, bleaches, body oils, body washes, breath fresheners, butters, candies, cleaner oils, cleaners, coffee extracts, colognes, colorants, condiments, conditioners, creamers, creams, dairy products, decongestants, deodorants, disinfectants, drinks, edible oils, emulsions, essential oils, eye drops, eye lubricants, fabric conditioners, fabric softeners, fertilizers, flavorings, foods, fragrances, fruit jellies, fruit spreads, fuel treatments, gels, glass cleaners, gravies, greases, hair treatments, hairdressings, hand sanitizing fluids, hand soaps, herbal extracts, honeys, insect repellants, jams, liniments, lip balms, lotions, makeup fluids, margarines, marmalades, medications, mineral solutions, moisturizers, mouthwashes, nectars, oils, ointments, paints, pastes, perfumes, petroleum jellies, polishes, preserves, salad dressings, salsas, sauces, seasonings, shampoos, skin cremes, skin lotions, skin moisturizers, skin toners, soaps, soups, spices, spreads, stain removers, styling creams, styling gels, sugar solutions, sun screens, sweeteners, syrups, tea extracts, toothpaste, vegetable milks, vegetable oils, vinegars, vitamin solutions, waxes and combinations thereof.

16. A method of advertising, comprising the steps of:

distributing to a user a polymeric packet containing a useful liquid and a packet-stiffening insert bearing a meaningful communication;

said user retaining said packet for one of use of said liquid and for the desirability of said meaningful communication to said user; and said user possessing said packet exposes said user to said meaningful communication that conveys an advertising message to said user.

* * * * *